US009186003B2

(12) United States Patent
Hsu

(10) Patent No.: US 9,186,003 B2
(45) Date of Patent: Nov. 17, 2015

(54) TRAVEL PILLOW AND METHOD THEREFOR

(71) Applicant: Obedo Enterprises, Inc., Vancouver (CA)

(72) Inventor: Gordon Hsu, Vancouver (CA)

(73) Assignee: Obedo Enterprises, Inc., Vancouver (CA)

( * ) Notice: Subject to any disclaimer, the term of this patent is extended or adjusted under 35 U.S.C. 154(b) by 0 days.

(21) Appl. No.: 14/096,644

(22) Filed: Dec. 4, 2013

(65) Prior Publication Data

US 2015/0150391 A1 Jun. 4, 2015

Related U.S. Application Data

(60) Provisional application No. 61/774,130, filed on Mar. 7, 2013.

(51) Int. Cl.

| | |
|---|---|
| ***A47C 20/00*** | (2006.01) |
| ***A47G 9/10*** | (2006.01) |
| ***A47C 7/38*** | (2006.01) |

(52) U.S. Cl.

CPC . *A47G 9/10* (2013.01); *A47C 7/383* (2013.01); *A47G 9/1081* (2013.01)

(58) Field of Classification Search

CPC ..... A47G 9/10; A47G 9/1045; A47G 9/1081
USPC ..... 5/630, 636, 637, 643, 633, 652, 490
See application file for complete search history.

(56) References Cited

U.S. PATENT DOCUMENTS

| | | | | | |
|---|---|---|---|---|---|
| 924,893 | A | * | 6/1909 | Doddridge | 5/491 |
| 926,563 | A | * | 6/1909 | Hobson | 5/640 |
| 958,502 | A | * | 5/1910 | Kennedy | 5/640 |
| 982,442 | A | * | 1/1911 | Rebhun | 5/640 |
| 1,231,839 | A | * | 7/1917 | Berlin | 5/630 |
| 1,274,595 | A | * | 8/1918 | Ranz | 5/636 |
| 1,935,034 | A | * | 11/1933 | Law | 5/636 |
| 1,973,240 | A | * | 9/1934 | Proudfit et al. | 27/13 |
| 3,242,511 | A | * | 3/1966 | Fultz et al. | 5/655.9 |
| 3,258,790 | A | * | 7/1966 | Maru | 5/636 |

(Continued)

FOREIGN PATENT DOCUMENTS

| | | | |
|---|---|---|---|
| AU | 2013206536 | A1 | 10/2013 |
| BR | PI0609005 | A2 | 1/2010 |

(Continued)

OTHER PUBLICATIONS

Mabis/DMI Cervical Dream Pillow on Amazon.com: http://www.amazon.com/Mabis-DMI-Healthcare-Cervical-Pillow/product-reviews/B000BHBYRK/ref=dp_db_cm_cr_acr_txt?ie=UTF8&showViewpoints=1.*

(Continued)

*Primary Examiner* — Timothy D Collins
*Assistant Examiner* — Richard G Davis
(74) *Attorney, Agent, or Firm* — Clegg, PC; Perry S. Clegg

(57) ABSTRACT

A pillow for supporting the head and neck of a user has a tubular structure, wherein the tubular structure has a first conical half and a second conical half. A depression is formed between the first conical half and the second conical half, the depression supporting a neck of a user.

19 Claims, 18 Drawing Sheets

(56) References Cited

U.S. PATENT DOCUMENTS

| | | | | | |
|---|---|---|---|---|---|
| 3,263,246 | A | * | 8/1966 | Towery | 5/639 |
| 3,698,023 | A | | 10/1972 | Archbold | |
| 4,007,503 | A | * | 2/1977 | Watkin | 5/490 |
| 4,081,870 | A | * | 4/1978 | Iannucci | 5/652 |
| D251,935 | S | * | 5/1979 | Ikezaki | D3/274 |
| 5,138,732 | A | | 8/1992 | Wattie et al. | |
| 5,148,564 | A | * | 9/1992 | Reder | 5/636 |
| 5,239,717 | A | * | 8/1993 | Sue | 5/655 |
| 5,440,769 | A | * | 8/1995 | Thomas | 5/655 |
| 5,535,467 | A | | 7/1996 | Ciske | |
| 5,535,468 | A | * | 7/1996 | Mallernee | 5/638 |
| 5,572,753 | A | * | 11/1996 | Ruscitto | 5/490 |
| 5,572,757 | A | * | 11/1996 | O'Sullivan | 5/636 |
| D387,937 | S | * | 12/1997 | Pujals, Jr. | D6/601 |
| 5,700,053 | A | * | 12/1997 | Downing | 297/227 |
| D391,112 | S | * | 2/1998 | Houston | D6/601 |
| 5,802,644 | A | * | 9/1998 | Scheurer | 5/640 |
| 5,904,406 | A | * | 5/1999 | Stewart | 297/397 |
| 5,907,876 | A | * | 6/1999 | Schwabe | 5/646 |
| 5,920,933 | A | | 7/1999 | Chou | |
| 5,992,939 | A | | 11/1999 | Gass et al. | |
| 6,041,458 | A | * | 3/2000 | Vickers et al. | 5/636 |
| 6,186,967 | B1 | * | 2/2001 | Messina | 602/23 |
| 6,231,535 | B1 | * | 5/2001 | Mainiero et al. | 602/18 |
| 6,381,786 | B1 | * | 5/2002 | Cadden | 5/655 |
| 6,625,831 | B2 | * | 9/2003 | Laughlin | 5/655.9 |
| 6,763,538 | B1 | * | 7/2004 | Tsai | 5/638 |
| 6,895,619 | B1 | | 5/2005 | Lee | |
| 6,951,038 | B1 | * | 10/2005 | Ganoe, Sr. | 5/644 |
| 7,131,156 | B1 | * | 11/2006 | Walker-Craft | 5/655 |
| 7,188,382 | B1 | * | 3/2007 | Taylor et al. | 5/648 |
| 7,261,374 | B2 | * | 8/2007 | Potosky | 297/227 |
| D580,695 | S | | 11/2008 | Negrin | |
| 7,908,692 | B2 | | 3/2011 | Lange | |
| 7,962,984 | B2 | | 6/2011 | Popp | |
| 7,975,336 | B1 | | 7/2011 | Perry et al. | |
| 8,002,682 | B2 | * | 8/2011 | Dye | 482/132 |
| D653,489 | S | | 2/2012 | Perry et al. | |
| 8,291,531 | B2 | * | 10/2012 | Kuo | 5/419 |
| 8,607,391 | B2 | * | 12/2013 | Poppe | 5/740 |
| 8,708,416 | B2 | * | 4/2014 | Stronconi | 297/397 |
| 2006/0021147 | A1 | * | 2/2006 | Inaba | 5/636 |
| 2006/0200910 | A1 | * | 9/2006 | Taylor | 5/652 |
| 2009/0211032 | A1 | | 8/2009 | Lange | |
| 2010/0043147 | A1 | * | 2/2010 | Popp | 5/636 |

FOREIGN PATENT DOCUMENTS

| | | | |
|---|---|---|---|
| CA | 2600812 | A1 | 9/2006 |
| CA | 2630424 | A1 | 11/2009 |
| CA | 2600812 | C | 1/2013 |
| CN | 101166446 | A | 4/2008 |
| CN | 201504911 | U | 6/2010 |
| CN | 201668170 | U | 12/2010 |
| CN | 102058295 | A | 5/2011 |
| CN | 101166446 | B | 5/2012 |
| CN | 203137802 | U | 8/2013 |
| DE | 29802 349 01 | | 6/1998 |
| EP | 1700544 | A1 | 9/2006 |
| EP | 1898749 | A1 | 3/2008 |
| JP | 2005-21230 | A | 1/2005 |
| JP | 2008532595 | A | 8/2008 |
| JP | 2011-30593 | A | 2/2011 |
| JP | 2011-244990 | A | 12/2011 |
| JP | 5047155 | B2 | 10/2012 |
| MX | 2007011068 | A | 2/2008 |
| RU | 2007137657 | A | 4/2009 |
| RU | 2395223 | C2 | 7/2010 |
| WO | 2006094509 | A1 | 9/2006 |

OTHER PUBLICATIONS

Neckii, website, http://www.neckii.com/.

International Search Report and Written Opinion of the International Searching Authority in related PCT application No. PCT/IB2014/059439.

Cervical Dream Pillow https://shop.briggscorp.com/e2wItemMain.aspx?parentId=IT00006097.

Duro-Med Cervical Contour Pillow http://www.amazon.ca/DMI-554-8024-1900-Duro-Med-Cervical-Contour/dp/B0009STNB0/ref=sr_1_1?ie=UTF8&qid=1424471585&sr=8-1&keywords=duro+med+cervical+contour.

* cited by examiner

TRAVEL PILLOW AND METHOD THEREFOR

RELATED APPLICATIONS

This patent application is related to U.S. Provisional Application No. 61/774,130, filed Mar. 7, 2013, entitled "TRAVEL PILLOW AND METHOD THEREFOR" in the name of Gordon Hsu, and which is incorporated herein by reference in its entirety. The present patent application claims the benefit of U.S. Provisional Application No. 61/774,130, filed Mar. 7, 2013, under 35 U.S.C. §119(e).

TECHNICAL FIELD

This invention relates generally to a pillow, and, more particularly, to a travel pillow which is compact for easy storage when not in use but which can be easily assembled to provide neck and spine support when travelling and or sleeping.

BACKGROUND

Travelers who are forced to sit for a long time in an upright posture have long struggled with obtaining adequate neck support and back support so that back or neck problems are not made worse as a result of their having to sit for a long time in planes, cars, buses, or trains. As a result of this problem, different types of neck pillows have been developed.

In general, most neck pillows are horseshoe-shaped collars which fit around the neck of the wearer. The horseshoe-shaped neck pillow, ideally, fits around the neck and sits on the shoulders and supports the back of the neck to prevent the head from tilting sharply to one side, so that any hinging of the neck (such as might occur when a person nods off to sleep) is minimized. Neck pillows also fill in the gap directly between the neck and the chair which also provides support and assist with relaxing when in a confined space.

In the past, there are two primary types of horseshoe-shaped neck pillows, pre-filled with materials and inflatable. The inflatable type of neck pillows are compact and allow the user to easily store the inflatable type of neck pillow in the luggage of the user until required by the user. When the user needs the inflatable type of neck pillow, the user needs to remove the inflatable type of neck pillow from the user's luggage and then must inflate the inflatable type of neck pillow. Unfortunately, this requires the user to spend several minutes blowing and or breathing air into a fill port of the inflatable type of neck pillow. This is both time consuming and can be exhausting to many users. Further, unless the inflatable type of neck pillow is properly inflated, the inflatable type of neck pillow tends to provide insufficient support. If the pillow is too inflated, the support is too stiff while if under inflated, the support is insufficient. Additionally, the regular plastic material used to contain the air within inflatable pillows may cause the user to retain heat during use as it is not necessarily a breathable material directly behind the wearer's neck.

Another type of horseshoe-shaped neck pillows are pre-filled with foam, feathers, or organic granular or bark-type materials. The problem with these types of horseshoe-shaped neck pillows are that they take up space in the user's luggage. The bulky form factor for these types of horseshoe-shaped neck pillows can take up approximately ⅓ of a carry-on piece of luggage and with today's limited carry-on capacity, portability has become an important value proposition when buying neck support devices. Further, once the traveling time is over, this type of horseshoe-shaped neck pillow becomes a weight to be carried around and stored until the next usage. From a functional perspective, these types of horseshoe-shaped travel or neck pillows can push the neck too far forward which is uncomfortable and not an appropriate position for the neck.

Therefore, it would be desirable to provide a device and method that overcomes the above problems.

SUMMARY

A pillow for supporting the head and neck of a user has a tubular structure, wherein the tubular structure has a first conical half and a second conical half. A depression is formed between the first conical half and the second conical half, the depression supporting a neck of a user.

A pillow for supporting the head and neck of a user has a tubular structure formed of a single planar member. The single planar member is rolled to form the tubular structure having a first conical half and a second conical half. A depression is formed between the first conical half and the second conical half for supporting a neck of a user. An attachment device is used for holding the single planar member in a form of the tubular structure. A collar member may be attached to each end of the tubular structure.

The foregoing and other objects, features, and advantages of the invention will be apparent from the following, more particular, description of the preferred embodiments of the invention, as illustrated in the accompanying drawings.

BRIEF DESCRIPTION OF DRAWINGS

The novel features believed to be characteristic of the application are set forth in the appended claims. In the descriptions that follow, like parts are marked throughout the specification and drawings with the same numerals. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings:

DESCRIPTION OF THE APPLICATION

The description set forth below in connection with the appended drawings is intended as a description of presently preferred embodiments of the application and is not intended to represent the only forms in which the present application can be constructed and/or utilized. The description sets forth the functions and the sequence of steps for constructing and operating the application in connection with the illustrated embodiments. It is to be understood, however, that the same or equivalent functions and sequences can be accomplished by different embodiments that are also intended to be encompassed within the spirit and scope of this application. For instance, a similar embodiment could be used for a back support pillow.

The present design is composed of a thin contoured tube structure that is depressed in the middle to support the neck while expanded in tube ends to support the side leaning tendencies of a head while seated in a slightly reclined and/or reclined manner. The neck and head resting on the device will cause compression of the tube structure. The tube structure may be made of various flexible materials such as foam. However, other types of material may be used as well. Although the internal space is hollow and is not filled with air nor filling, the strength of the structure against compression relies on the material used and the design that provides resistance against compression. However, air pockets or filling or heating or cooling or vibrating mechanisms may be included without departing from the spirit and scope of the present invention. The outer surface is textured to provide a soft supportive effect that relies on the inherent compression resistant architecture. A fabric cover may be placed around the product and the fabric can vary in thickness and texture. This fabric, stretched over the foam and configured in a certain way, will provide further neck support for the user. Additionally the textured surface may provide airflow to keep the neck and head cool. The concept includes a foldable capability to enhance portability; however, for use in environments where portability may not be required, like home use, the device may be produced without the folding and or hollow characteristics. Therefore, a solid form that provides the same support characteristics but not a horseshoe shape may be created.

Figure 1A:
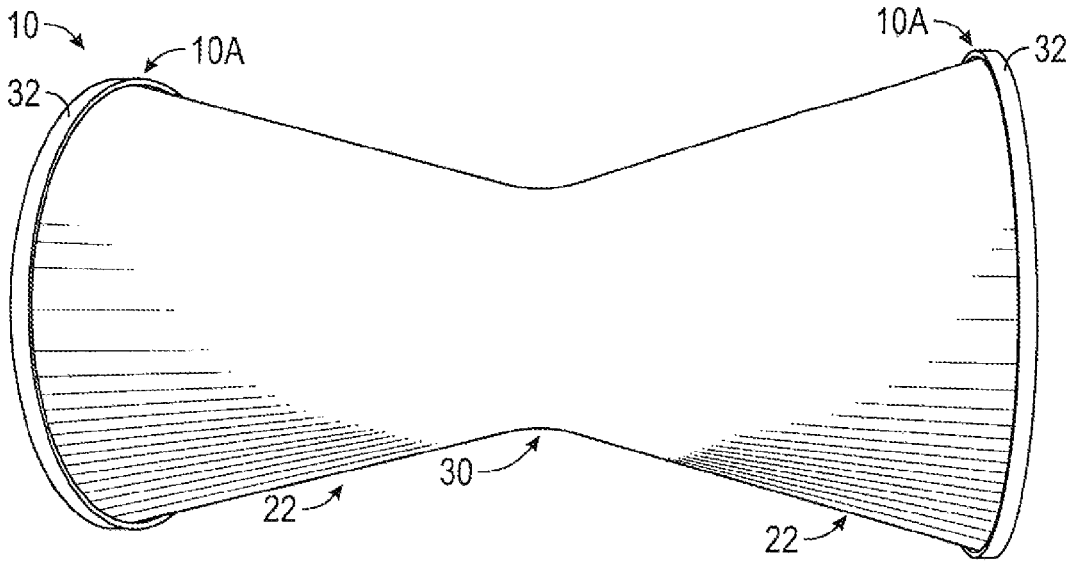
FIG. 1A is a perspective view of a neck pillow in accordance with one or more aspects of the present invention.
Figure 1B:
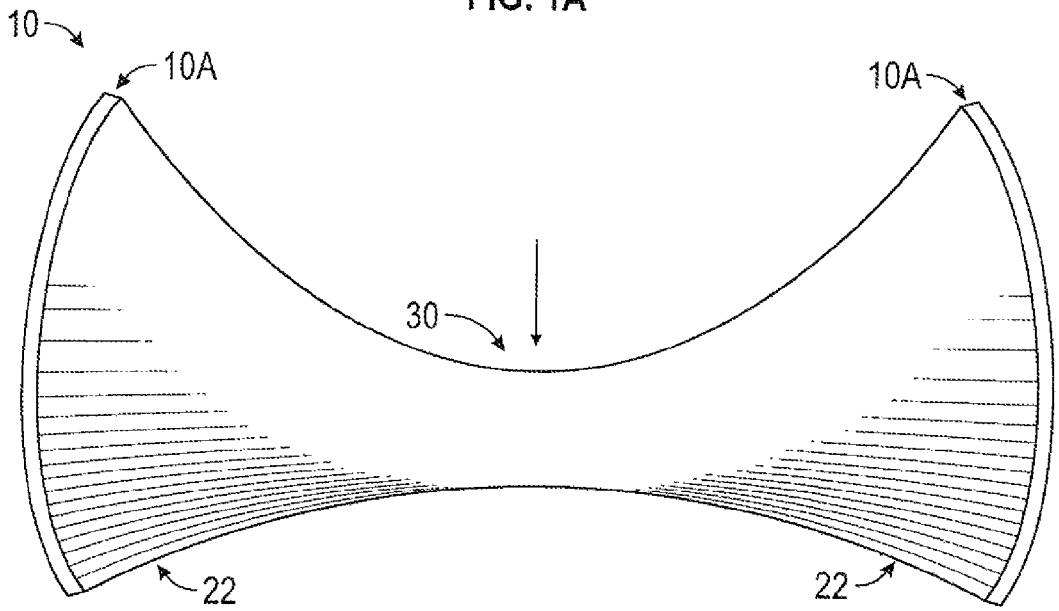
FIG. 1B is a perspective view of a neck pillow of FIG. 1A showing the neck pillow slightly compressed in accordance with one or more aspects of the present invention.
Figure 2:
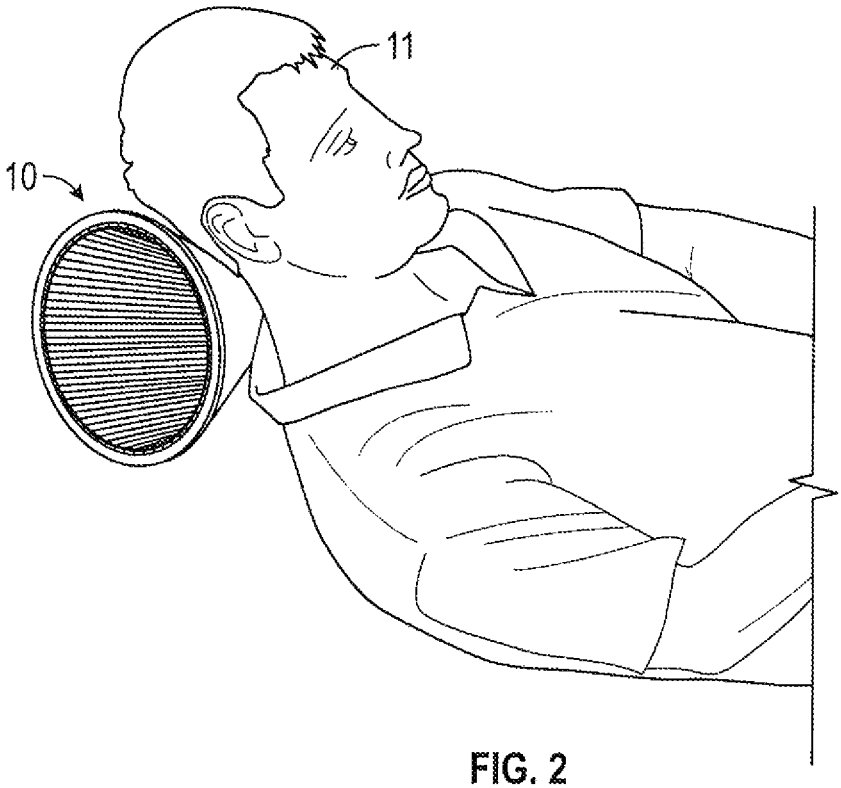
FIG. 2 is a perspective view of a neck pillow being used by an individual in accordance with one or more aspects of the present invention.
Figure 3:
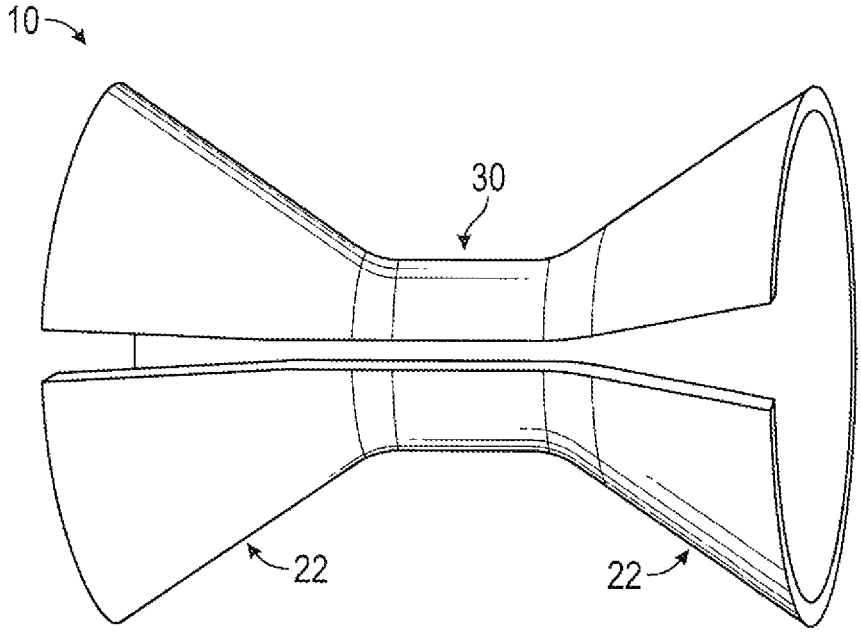
FIG. 3 is a perspective view of a neck pillow showing an opening for unrolling the neck pillow for storage in accordance with one or more aspects of the present invention.

Referring to the FIGS. 1-3, a neck pillow 10 is shown. In an assembled form, the neck pillow 10 may be a hollow tubular design which may take the form of a pair of conical halves 22 that are attached on the smaller end thereof so that the neck pillow 10 may be hourglass in shape. A depression 30 may be formed where the pair of conical halves 22 comes together. The depression 30 may be used to support the neck of a user as shown in FIG. 2. The expanding nature of the conical halves 22 may be used to support the side leaning tendencies of a head of a user while seated in a slightly reclined or reclined manner.

As shown in FIGS. 1B-2, when pressure, such as when a user 11 placing his/her neck on the depression 30, is applied to a top area of the depression 30, the depression 30 sinks inward. The ends 10A of the neck pillow 10 may move slightly inward and may be used to support the side leaning tendencies of a head of a user while seated in a slightly reclined or reclined manner.

While FIGS. 1-3 show the neck pillow 10 having a pair of conical halves 22, the neck pillow 10 may take on other shapes. Referring to FIGS. 4A-4F, the neck pillow 10 may take different configurations as shown. Each of the configurations shown in FIGS. 4A-4E have the depression 30 and raised ends 10A.

Figure 4A:
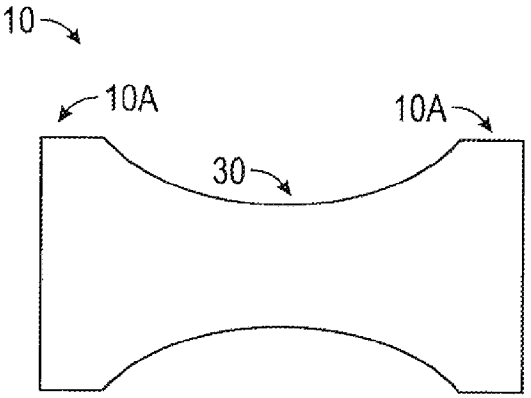
FIG. 4A shows a shape configuration of a neck pillow in accordance with one or more aspects of the present invention.
Figure 4B:
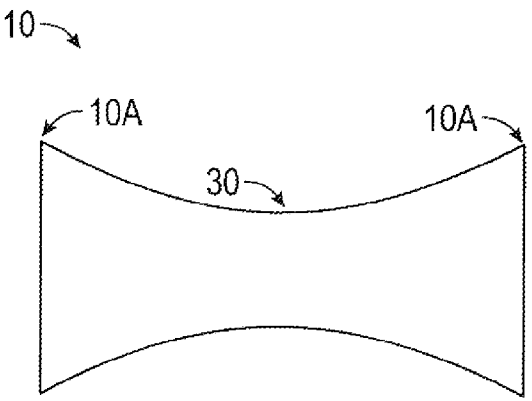
FIG. 4B shows a shape configuration of a neck pillow in accordance with one or more aspects of the present invention.
Figure 4C:
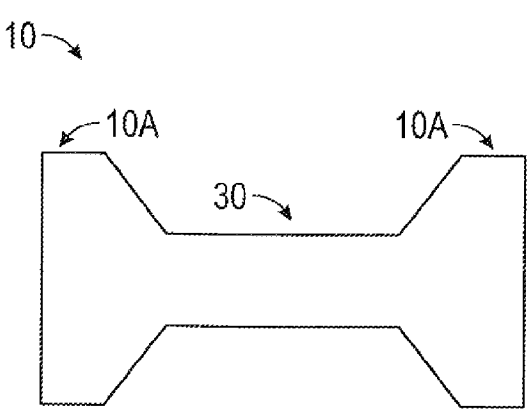
FIG. 4C shows a shape configuration of a neck pillow in accordance with one or more aspects of the present invention.
Figure 4D:
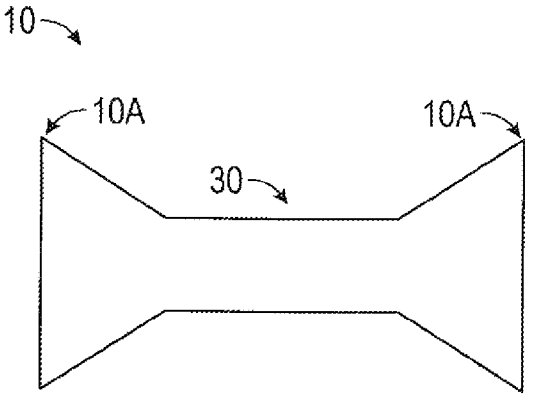
FIG. 4D shows a shape configuration of a neck pillow in accordance with one or more aspects of the present invention.
Figure 4E:
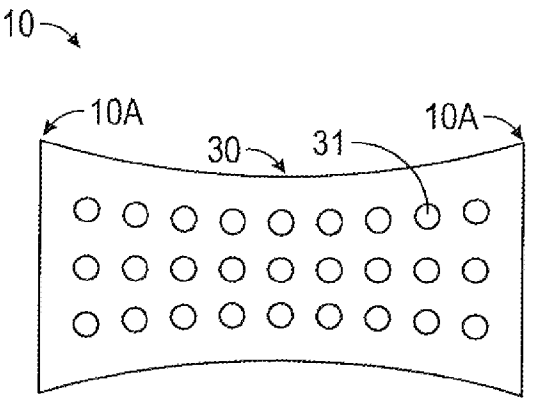
FIG. 4E shows a shape configuration of a neck pillow in accordance with one or more aspects of the present invention.
Figure 4F:
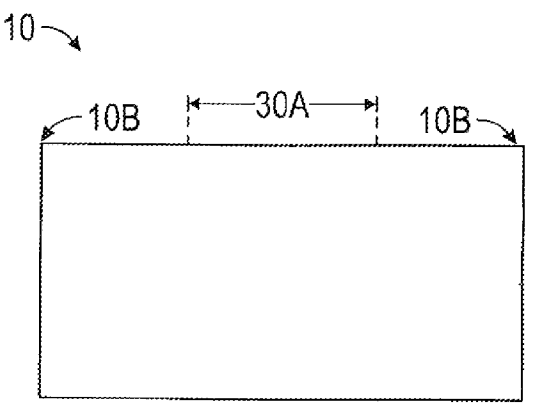
FIG. 4F shows a shape configuration of a neck pillow in accordance with one or more aspects of the present invention.
Figure 5:
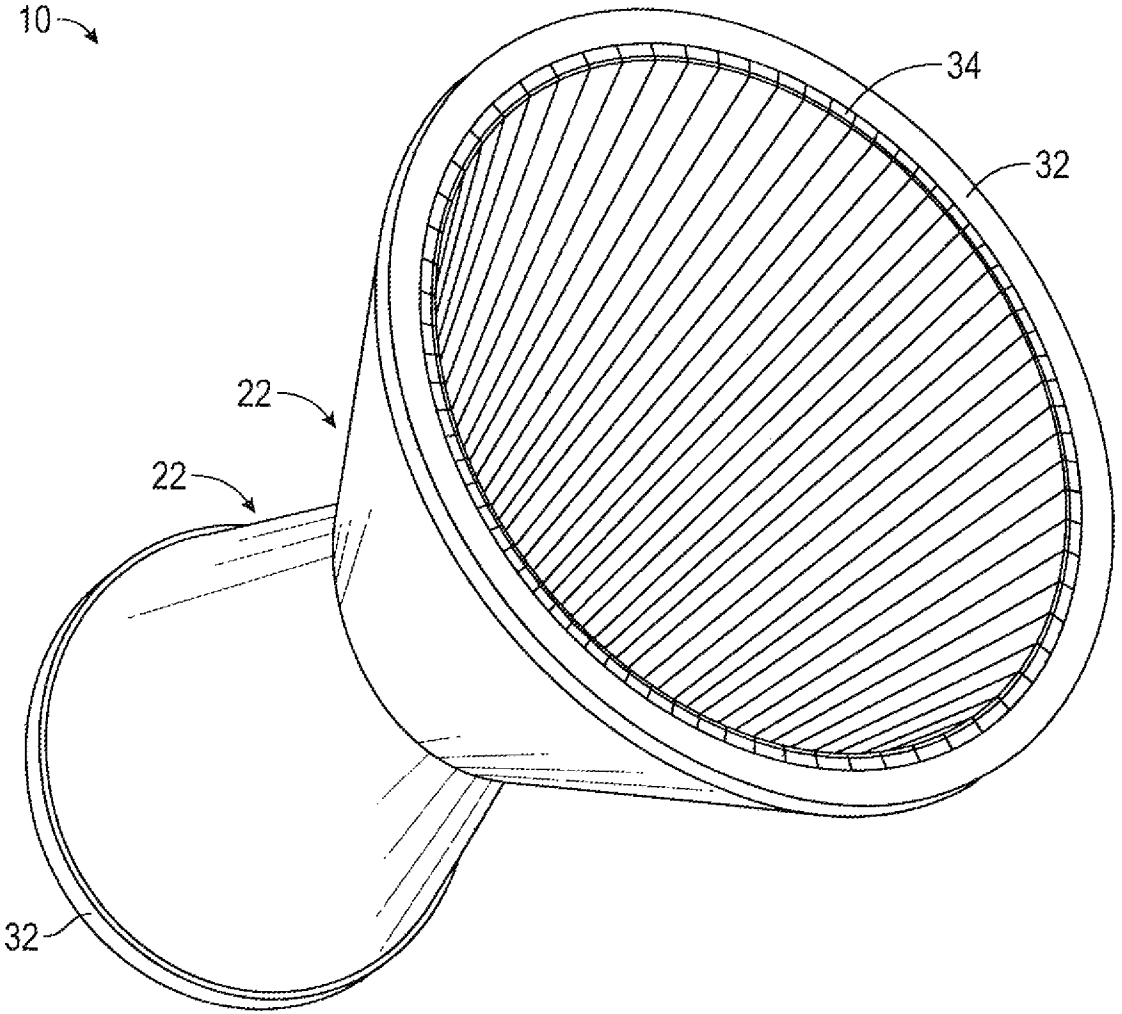
FIG. 5 shows an angled end perspective view of a neck pillow in accordance with one or more aspects of the present invention.
Figure 6A:
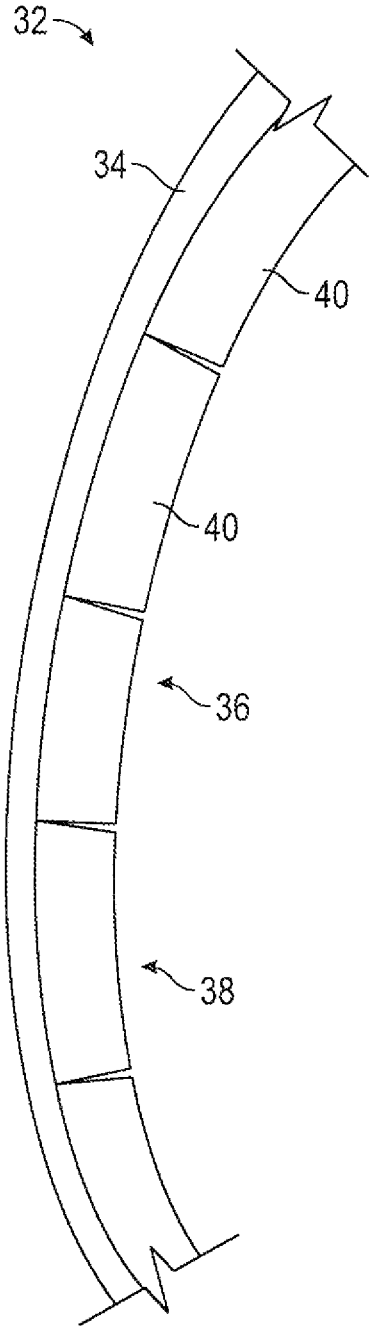
FIG. 6A shows a magnified view of an end ring member used in a neck pillow in accordance with one or more aspects of the present invention.
Figure 6B:
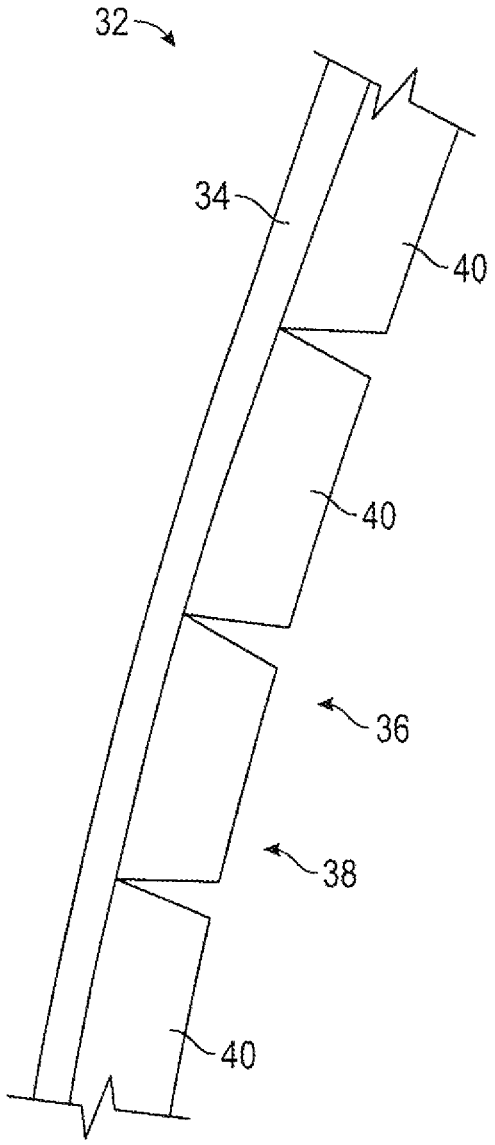
FIG. 6B shows another magnified view of an end ring member used in a neck pillow in accordance with one or more aspects of the present invention.
Figure 6C:
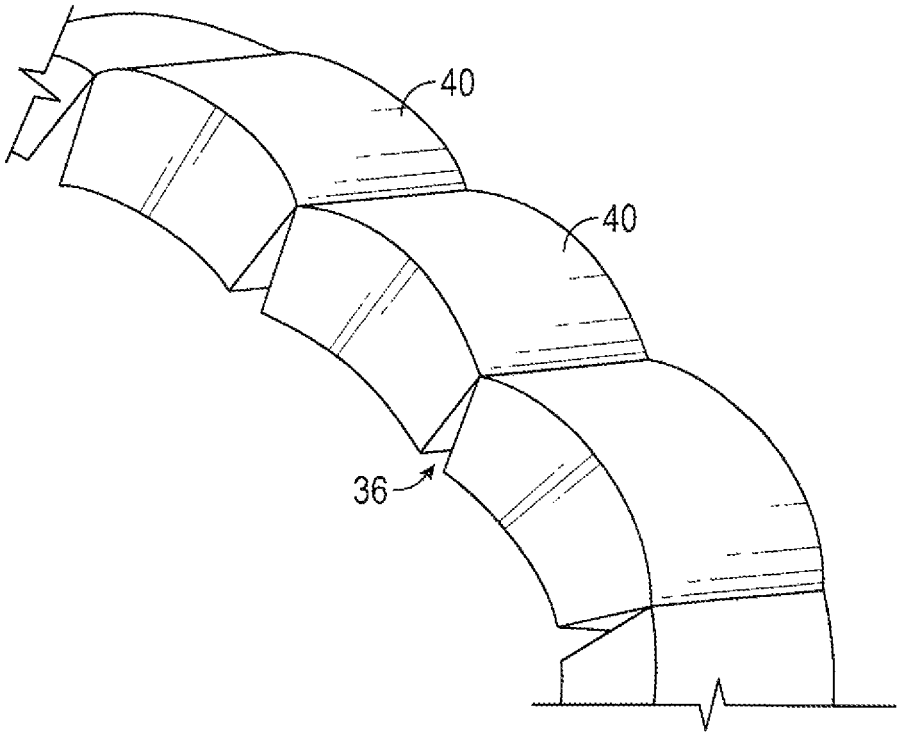
FIG. 6C shows a magnified view of a resistance device used in an end ring member used in a neck pillow in accordance with one or more aspects of the present invention.
Figure 6D:
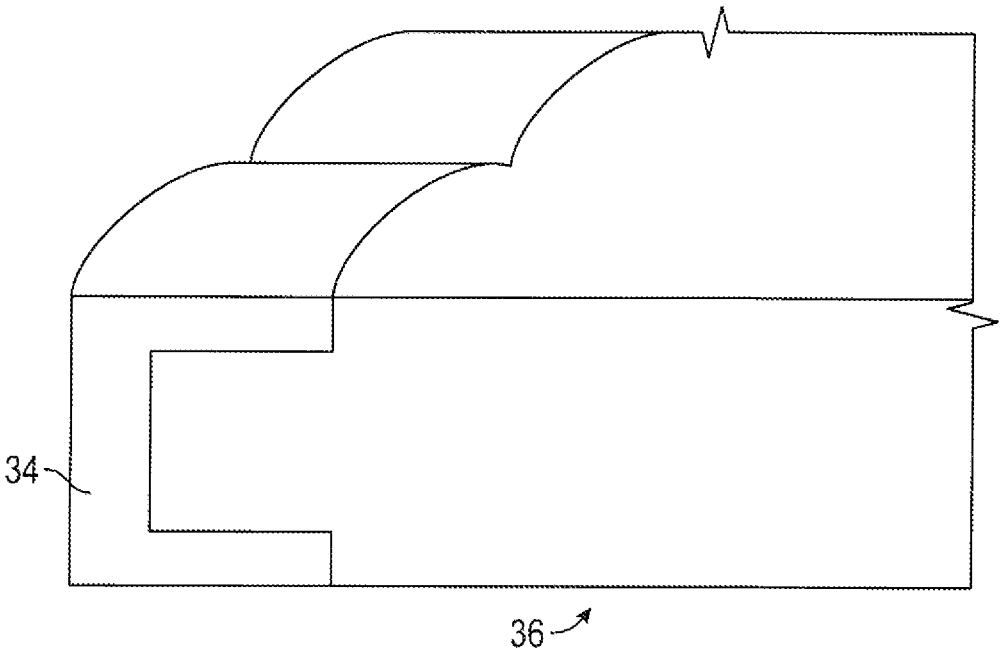
FIG. 6D shows a magnified view of a frame member used in an end ring member used in a neck pillow in accordance with one or more aspects of the present invention.

However, the depression 30 may be replaced as shown in FIG. 4F. In FIG. 4F, the neck pillow 10 may be formed of a rectangular shape wherein a center area 30A is formed of a softer material than the ends 10B. Thus, when the user's neck is applied to the center area 30A, the center area 30A sinks inward. The ends 10B of the neck pillow 10 may move slightly inward and may be used to support the side leaning tendencies of a head of a user while seated in a slightly reclined or reclined manner similar to the other configurations.

It should be noted that the configurations shown in FIGS. 4A-4F should not be seen in a limiting manner. Other configurations may be used without departing from the spirit and scope of the present invention. For example, while the neck pillow 10 shown in FIGS. 4A-4F may be seen as symmetrical in design, the neck pillow 10 may be asymmetrical in shape as well.

Referring now to all the Figures, in an unassembled form, the neck pillow 10 takes on a substantially flat structure which may easily be stored in a user's luggage. In accordance with one embodiment of the present invention, the neck pillow 10 may be formed of a single planar member 12 as may be seen in FIGS. 8A and 8B. The shape of the planar member 12 may dictate the shape of the neck pillow 10. In accordance with one embodiment, as shown in the Figures, the planar member 12 may be shaped as a pair of trapezoidal halves. The trapezoidal halves may be symmetrical. A single layer without trapezoidal halves can be seen in FIG. 3. However, asymmetrical halves may also be used without departing from the spirit and scope of the present invention.

Figure 8A:
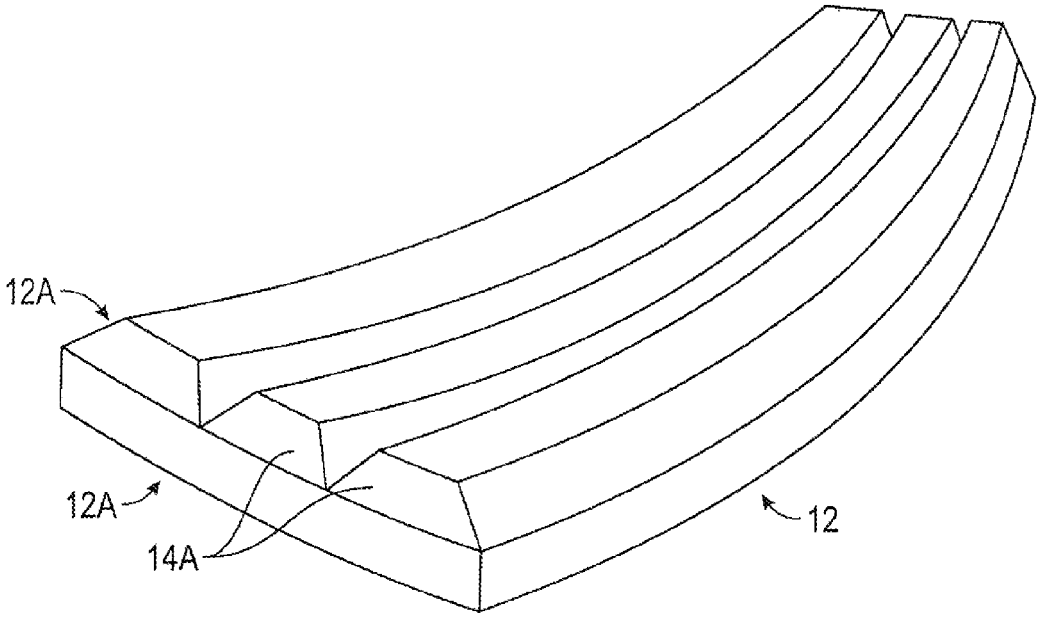
FIG. 8A shows an angled perspective of a magnified partial cutaway view of a portion of a neck pillow unrolled in accordance with one or more aspects of the present invention.
Figure 8B:
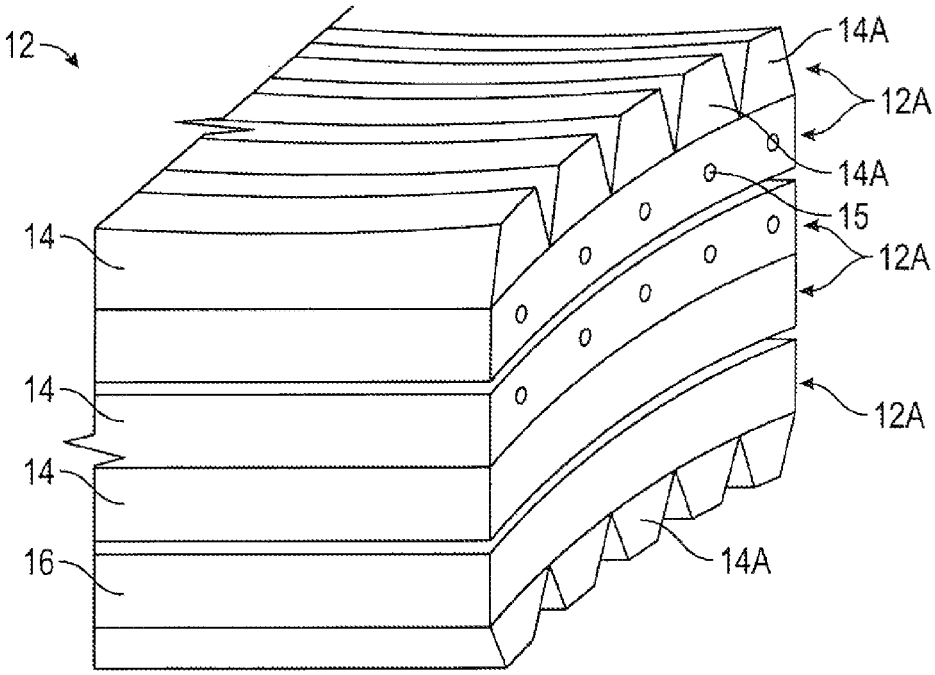
FIG. 8B shows an angled perspective of a magnified partial cutaway view of another embodiment of a portion of a neck pillow unrolled in accordance with one or more aspects of the present invention.

The planar member 12 may be comprised of one or more different layers. For example, FIG. 3 shows that the neck pillow 10 is formed of a planar member 12 made of a single layer. In accordance with another embodiment, the planar member 12 may be comprised of a plurality of layers 12A as shown in FIGS. 8A-8B. For example, the planar member 12 may be comprised of one or more hard foam layers 14. A softer foam layer 16 may be positioned on exposed sides of the neck pillow 10. Each of the plurality of layers 12A may be of different density/support and a variety of layer positions (i.e. outer cone shapes may be harder layers while inner cylinder section is relatively softer) and these varying designs will allow the product to provide varying comfort and support against compression.

Figure 8C:
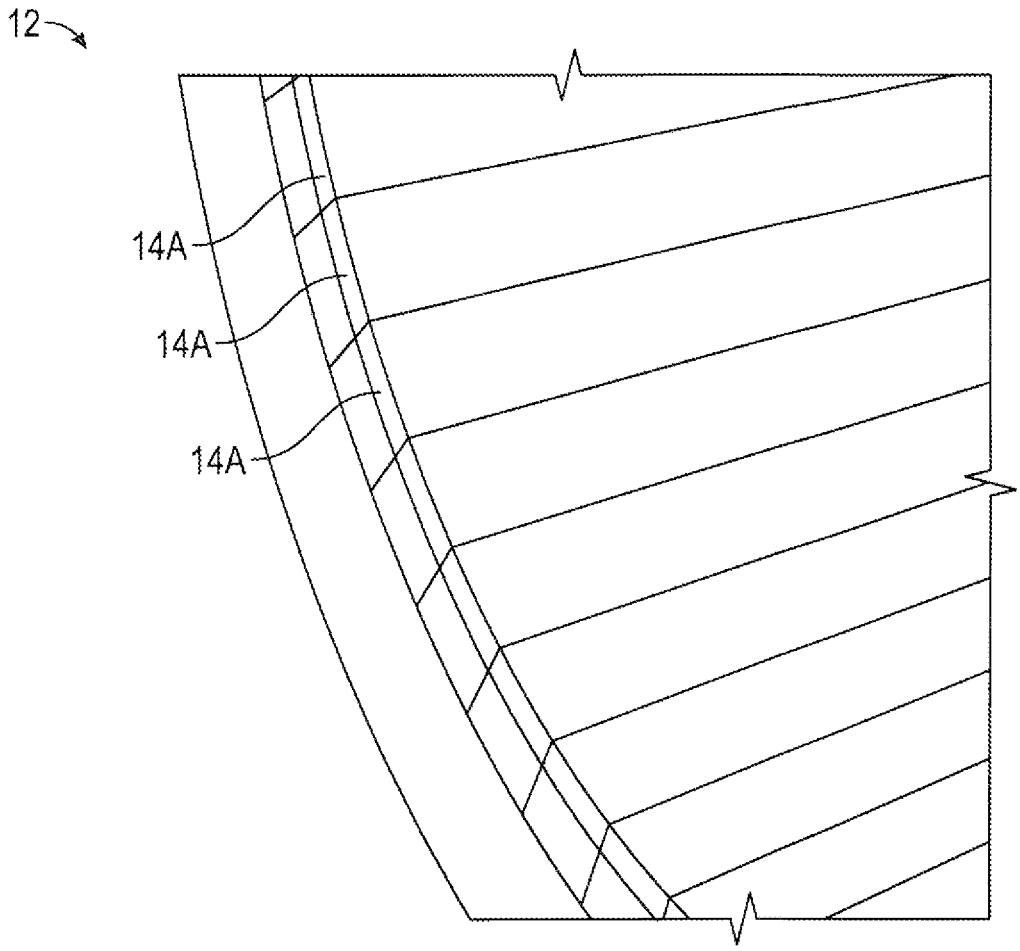
FIG. 8C shows a magnified perspective view of an end portion of a neck pillow partially rolled in accordance with one or more aspects of the present invention.

As shown in FIGS. 8A-8C, the layer 14 may be formed of a plurality of strips 14A. In the embodiment shown, each of the plurality of strips 14A may be trapezoidal in shape. Thus, when the neck pillow 10 is rolled and assembled, the trapezoidal shape of the plurality of strips 14A press against each other as shown in FIG. 8C to provide additional support.

One or more of the plurality of layers 12A may have strips of denser material 15 that are oriented longitudinally or horizontally (perpendicular to the longitude axis) formed within the layer 12. The denser material 15 may be used to provide the neck pillow a firmer feel.

In accordance with one embodiment, the planar member 12 may have a plurality of holes and or openings 31 (hereinafter openings 31) formed there-through as shown in FIG. 4E. The openings 31 may be formed to allow air to flow through the planar member 12 and hence the neck pillow 10. Thus, the openings 31 may be used to prevent the neck pillow 10 from retaining heat when in use.

One or more attachment devices 16 may be attached to the planar member 12. The attachment devices 16 may be used to assemble the neck pillow 10 to form a tubular design. While the tubular design of the assembled neck pillow 10 may be hollow, the assembled neck pillow 10 may take on a solid design. In accordance with one embodiment as may be seen in FIGS. 9A-9D, the attachment device 16 may be a zipper 20. The zipper 20 may be formed of a first set of teeth 21 formed on one end of the planar member 12 and a second set of teeth 23 formed on a second end of the planar member 12. A sliding body 25 may be used to secure the first set of teeth 21 to the second set of teeth 23 to form the tubular structure of an assembled neck pillow 10.

Figure 12A:
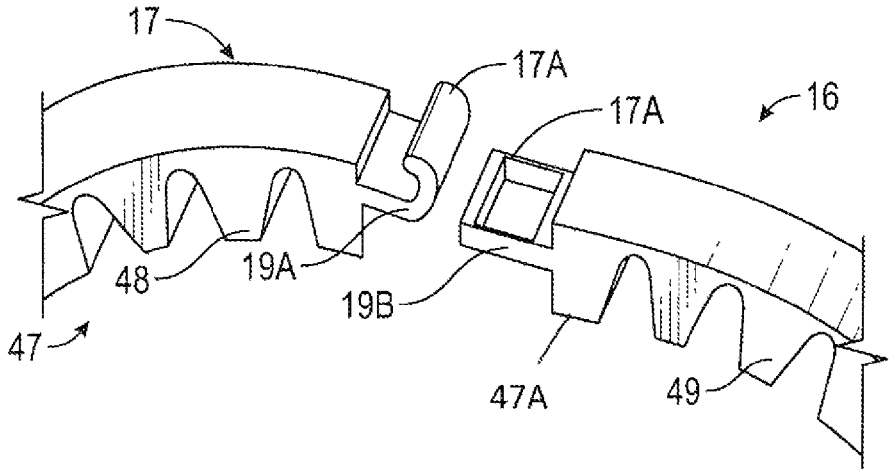
FIG. 12A shows a locking device for the neck pillow of FIG. 10 in accordance with one or more aspects of the present invention.
Figure 12B:
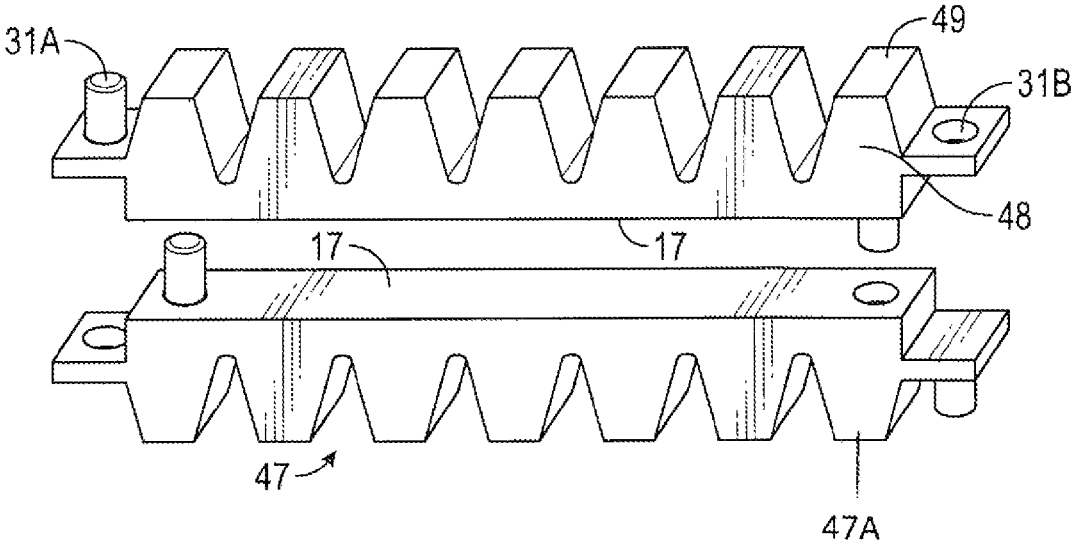
FIG. 12B shows another locking device for the neck pillow of FIG. 10 in accordance with one or more aspects of the present invention.

The attachment device 16 may take on other forms. A locking strip 17 or a locking strip 17 with a corresponding channel 17A as shown in FIGS. 10-12B may also be used. In this embodiment, a locking strip 17 may be placed around the neck pillow 10 to keep the neck pillow 10 in an assembled form. The locking strip 17 may have an attachment device 17A formed on each end of the locking strip 17. The attachment device 17A may be used to secure the locking strip 17 around the assembled neck pillow 10. The attachment device 17A may be a hook 19A and a loop 19B as shown in FIG. 12A, a male connector 31A and female connector 31B as shown in FIG. 12B, or the like. The above is given as an example and should not be seen in a limiting manner.

The locking strip 17 may have a resistance device 47. The resistance device 47 may be used to prevent the neck pillow 10 from folding inward and or collapsing when the locking strip 17 is used with the neck pillow 10. The resistance device 47 may be used to prevent the ends of the neck pillow 10 from folding inward and or collapsing. In accordance with one embodiment, the resistance device 47 may be a foam material 47A which is firmer than the material used to form the rest of the neck pillow structure. The foam material 47A may be divided into a plurality of sections 49. When pressure is applied to the neck pillow 10, each of the plurality of sections 49 may press into adjacent ones of the plurality of sections 49. As more pressure is applied, such as when a user moves his head closer to the locking strip 17, each of the plurality of sections 49 may press further into adjacent ones of the plurality of sections 49. Once the plurality of sections 49 are compressed, the plurality of sections 49 will prevent the ends of the neck pillow 10 from folding inward and or collapsing.

Further, one or more channels 17A may be formed in the planar member 12. The locking strip 17 may be positioned within a corresponding channel 17A to keep the neck pillow 10 in an assembled form.

Figure 13:
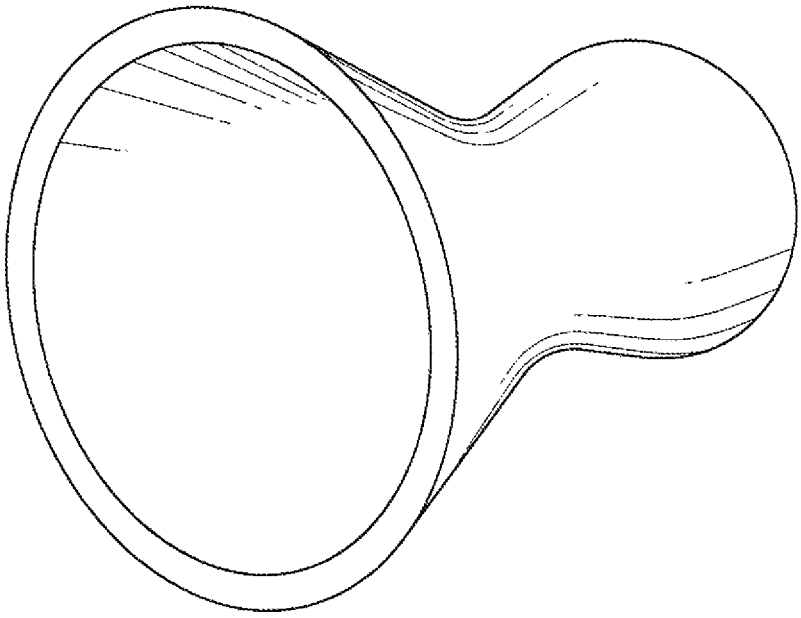
FIG. 13 shows another embodiment of a neck pillow in accordance with one or more aspects of the present invention.
Figure 14:
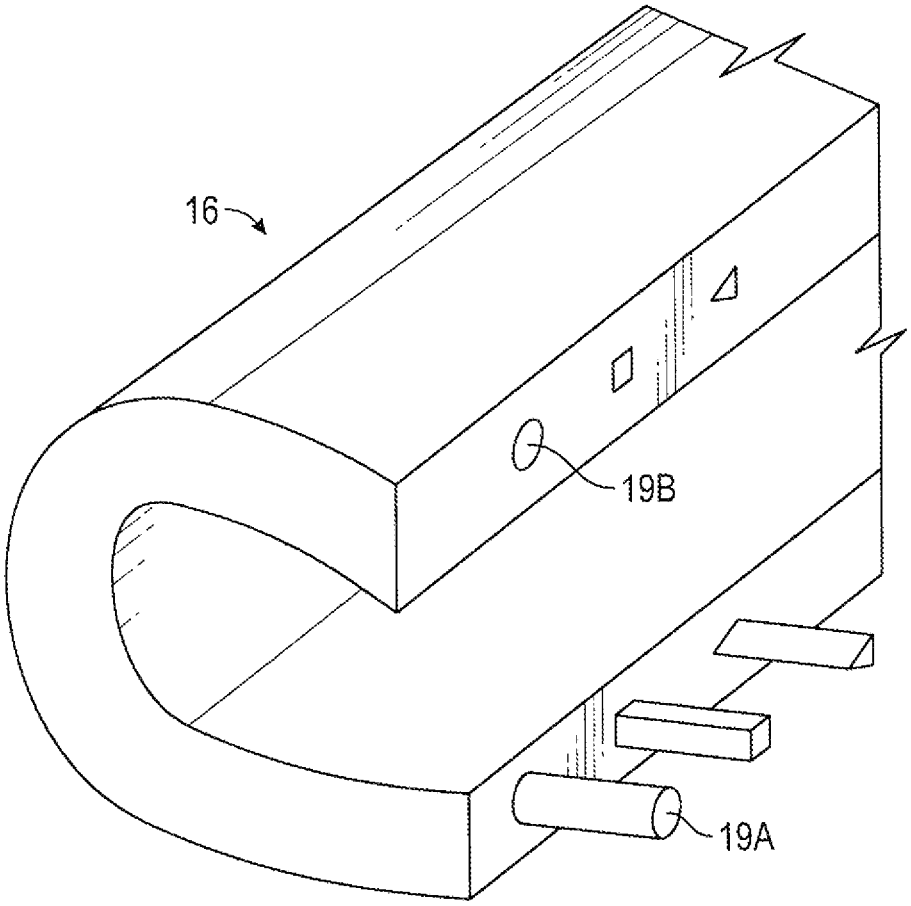
FIG. 14 shows a locking device for a neck pillow of FIG. 13 in accordance with one or more aspects of the present invention.

Alternatively, male/female connectors 19 may be used as the attachment device 16 as shown in FIGS. 13-14. In this embodiment, one end of the planar member 12 may have a male connector 19A while a second end of the planar member 12 may have a female connector 19B. In an assembled condition, the male connector 19A will be inserted into the female connector 19B to form the tubular structure of the neck pillow 10.

Figure 15:
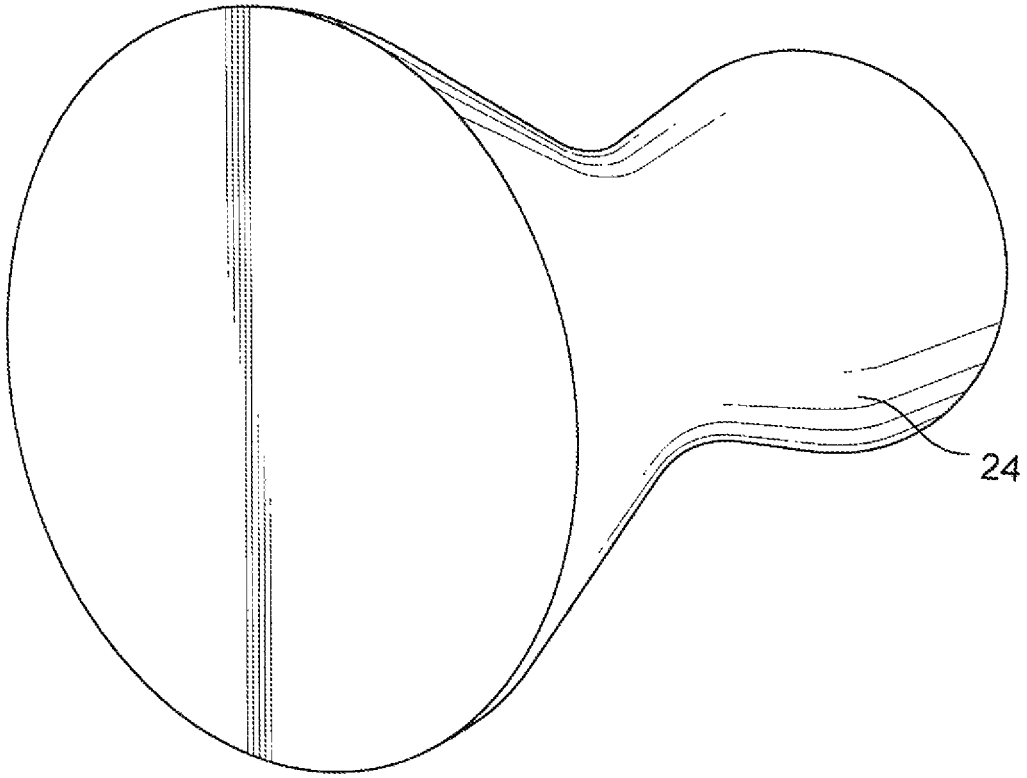
FIG. 15 is a perspective view of another embodiment of a neck pillow in accordance with one or more aspects of the present invention.
Figure 16A:
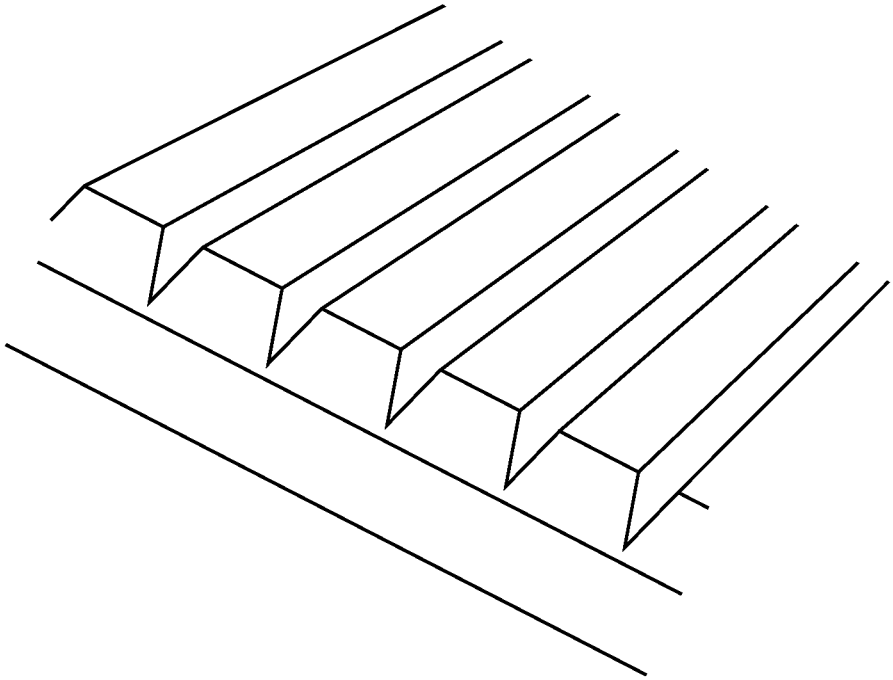
FIG. 16A illustrates a perspective view of an interior portion of an unrolled neck pillow in accordance with one or more aspects of the present invention.
Figure 16B:
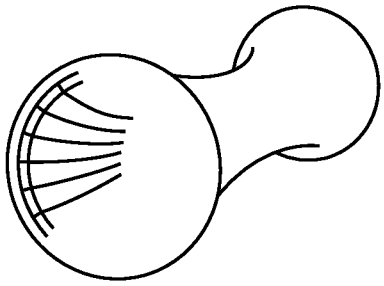
FIG. 16B illustrates an end perspective view of a rolled neck pillow in accordance with one or more aspects of the present invention.
Figure 16C:
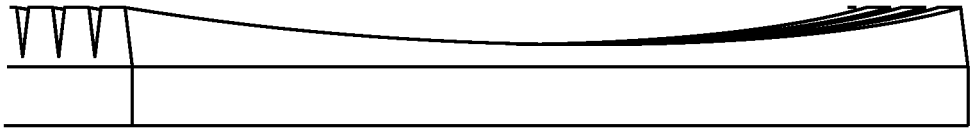
FIG. 16C illustrates a partial cross sectional view of a portion of a neck pillow illustrating a tapered or varying thickness of the foam layer or planar member forming the neck pillow in accordance with one or more aspects of an embodiment of the neck pillow shown in FIG. 16B.
Figure 17:
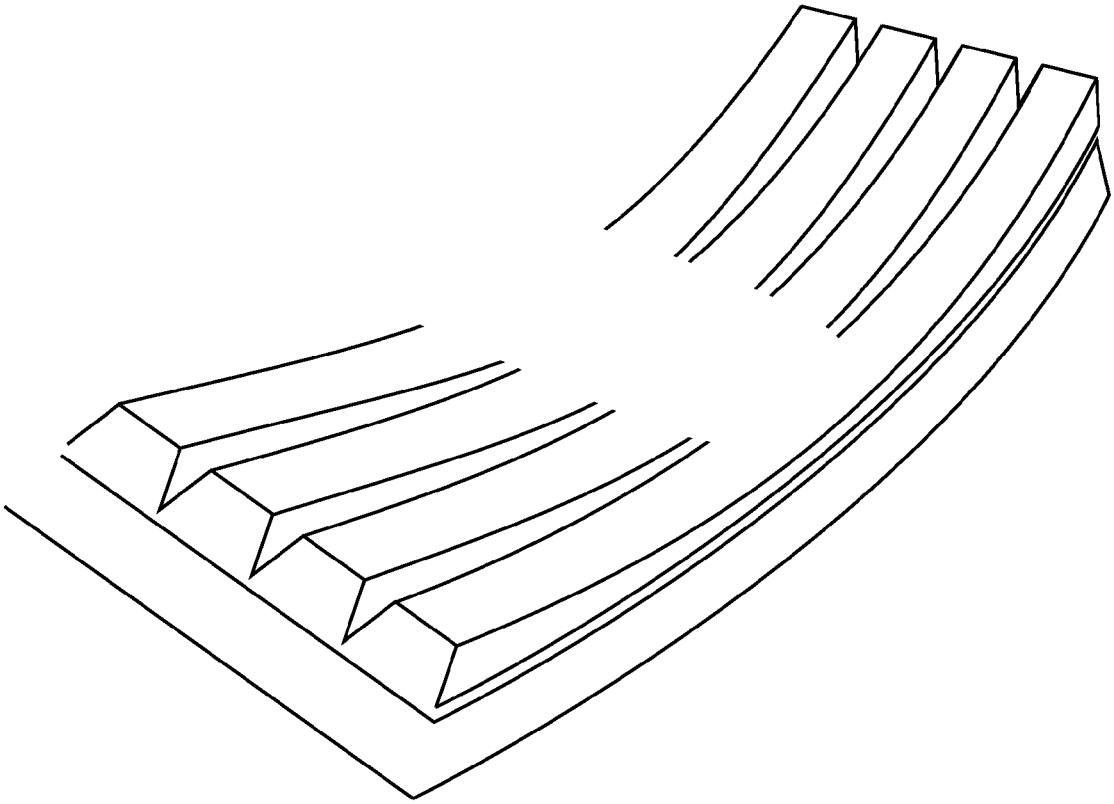
FIG. 17 illustrates a partial isometric view of an interior portion of a neck pillow illustrating a tapered or varying thickness of the foam layer or planar member forming the neck pillow in accordance with one or more aspects of an embodiment of the neck pillow shown in FIG. 16B.
Figure 18:
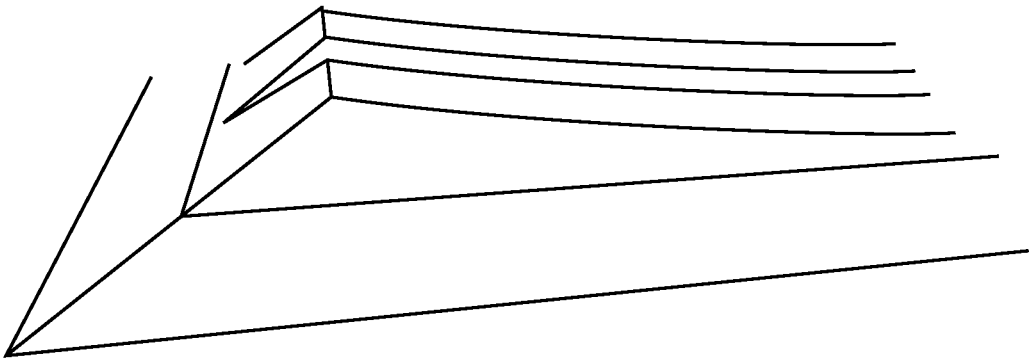
FIG. 18 illustrates a partial perspective view of an end portion of a neck pillow illustrating a tapered or varying thickness of the foam layer or planar member forming the neck pillow in accordance with one or more aspects of an embodiment of the neck pillow shown in FIG. 16B.
Figure 19:
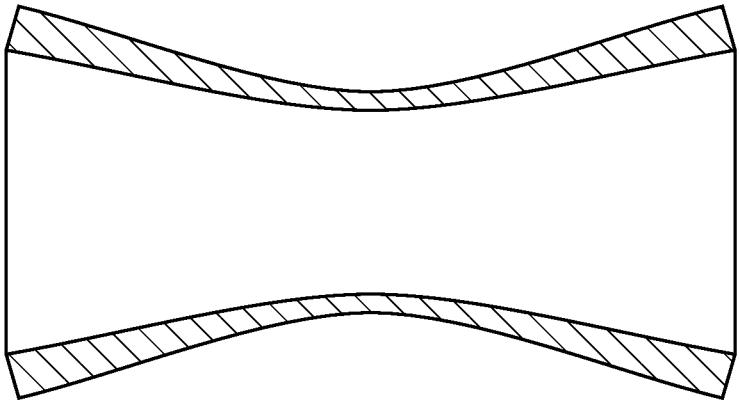
FIG. 19 illustrates a cutaway view of a neck pillow in accordance with one or more aspects of an embodiment of the neck pillow of FIG. 16B illustrating a tapered or varying thickness of the foam layer or planar member forming the neck pillow in accordance with one or more aspects of the present invention.

Alternatively, a covering 24 may be used to enclose the planar member 12 once the planar member 12 has been rolled to assemble the configuration of the neck pillow 10 as shown in FIG. 15. The covering 24 may serve several purposes. One, the covering 24 may serve as the attachment device 16 to keep the planar member 12 assembled to form a tubular design of the neck pillow 10. Further, when stretched over the rolled up planar member 12, the covering 24 can be integral and/or complementary for neck support. The covering 24 may add to the texture and comfort or allow for branding opportunities (logos). The covering 24 can be removable so one may be able to wash the covering 24. The covering 24 may also have an antimicrobial nature to prevent spreading of germs. The covering 24 may be formed of a microfiber material or the like. Other types of materials may be used without departing from the spirit and scope of the present invention.

In an assembled state, the neck pillow 10 may have a collar member 32 located on each end 12A of the neck pillow 10. The collar member 32 is designed to resist compression when the neck pillow 10 is in an assembled form and pressure is applied on the neck pillow 10. The collar member 32 may be formed of a material which is firmer than the material used to form the rest of the planar member 12. When the neck pillow 10 is disassembled, the collar member 32 unrolls to a flat line dimension. The collar member 32 may be detachable or permanently attached to the neck pillow 10.

As may be seen in the FIGS. 6A-6D, the collar member 32 may be comprised of a frame member 34. The frame member 34 may be used to attach the collar member 32 to the outer perimeter of each end of the neck pillow 10. Attached to the frame member 34 is a resistance device 36. The resistance device 36 may be used to prevent the neck pillow 10 from folding inward and or collapsing when in use. The resistance device 36 may be used to prevent the ends of the neck pillow 10 from folding inward and or collapsing.

In accordance with one embodiment, the resistance device 36 may be a foam material 38 which is firmer than the material used to form the rest of the neck pillow structure. The foam material 38 may be divided into a plurality of sections 40. As may be seen in the FIG. 6A, when the neck pillow 10 is assembled, each of the plurality of sections 40 may press into adjacent ones of the plurality of sections 40. As more pressure is applied, such as when a user moves his head closer to the edge of the neck pillow 10, each of the plurality of sections 40 may press further into adjacent ones of the plurality of sections 40. Since the plurality of sections 40 is formed of material that is firmer than the material used to form the rest of the neck pillow structure, the plurality of sections 40 have limited amount of compression. Once the plurality of sections 40 are compressed, the plurality of sections 40 will prevent the ends of the neck pillow 10 from folding inward and or collapsing.

In an alternative embodiment, the resistance device 36 may be directly attached to the outer perimeter of each end of the neck pillow 10. In this embodiment, the collar member 32 may not be needed.

Figure 7:
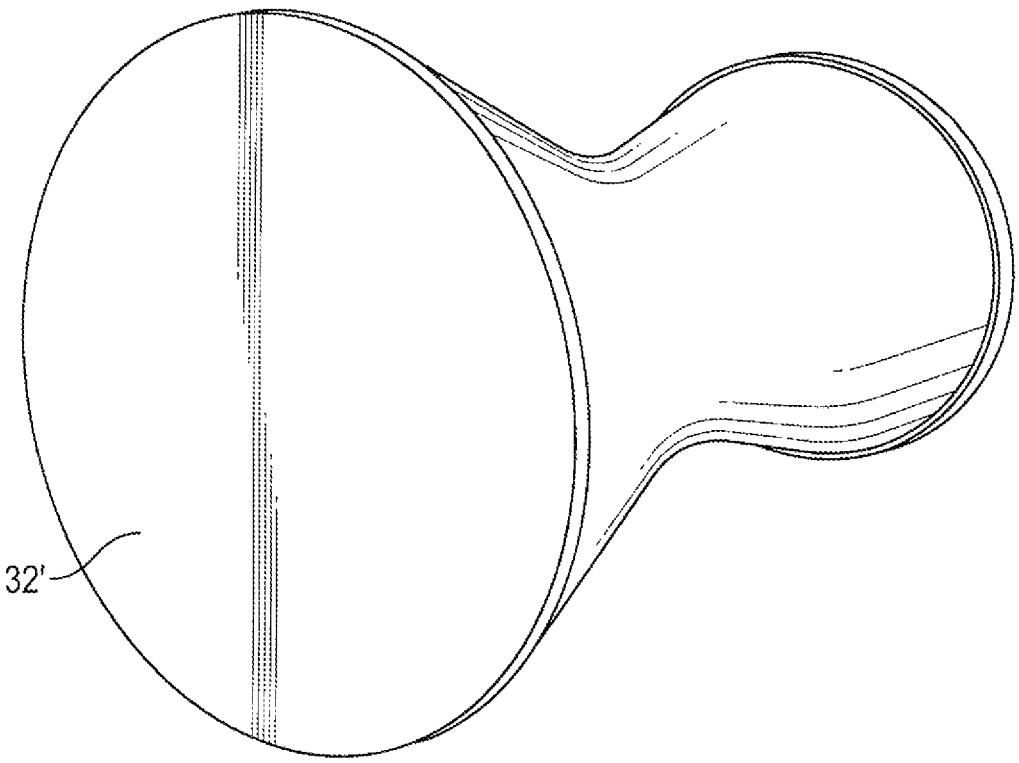
FIG. 7 shows an angled end perspective view of a neck pillow having a solid end cap in accordance with one or more aspects of the present invention.

While FIGS. 6A-6D shows the collar member 32 as being configured as a ring, this should not be seen in a limiting manner. The collar member 32 may take on different configurations without departing from the spirit and scope of the present invention. For example, FIG. 7 shows the collar member 32' as having more of a solid configuration.

In operation, when the neck pillow 10 is assembled, the neck pillow 10 is placed behind the neck of the user 11 and the neck is centered in the depression 30 of the contoured hourglass shape as shown in FIG. 2. As the user 11 sits back and compresses the neck pillow 10, the compression of the center will cause the ends 10A to move opposite in direction of the direction of pressure. The entire structure of the neck pillow 10 tends to partially wrap around the back and sides of the neck thus supporting the head from a side to side displacement. This neck pillow 10 may not stop the head from leaning forward but only support it from falling to the right or left and provide support directly behind the neck.

Referring now to FIGS. 9A-9H a method for converting the neck pillow 10 from a tubular configuration to a substantially flat structure will be disclosed. The method is described for the neck pillow 10 having a zipper 20 as the attachment device 16. When the user is done with the neck pillow 10, the neck pillow 10 may be broken along a connecting axis formed where the ends of the planar member 12 meet to form the tubular configuration of the neck pillow 10. The neck pillow 10 may be designed to allow the user to convert the contoured hourglass shaped neck pillow 10 to an almost flat structure by disengaging the connecting device 16 along the connecting axis of the contoured hourglass shaped neck pillow 10.

The neck pillow 10 may be converted to a flat structure by first disengaging the zipper 20. The user may pull the zipper 20 along the connecting axis as shown in FIG. 9B. Once the zipper 20 has been disengaged as shown in FIG. 9C, the ends on the planar member 12 are pulled apart as shown in FIG. 9D. The planar member 12 may then be folded as shown in FIGS. 9E-9F to form a substantially flat structure which may be easily stored. A flap member 31 may be pulled over the folded planar member 12 to hold and keep the planar member 12 in a folded position.

Alternatively, instead of the flap member 31, in the disassembled position, there may be an attachment mechanism that can be a hook and loop material, snaps, ties, or the like that assists with holding the neck pillow 10 in the disassembled position.

Figure 9A:
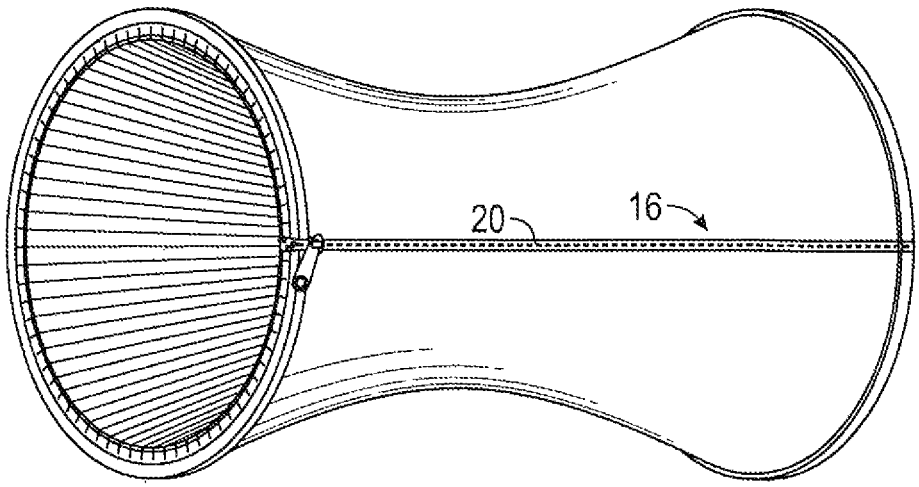
FIG. 9A shows a perspective view of an assembled neck pillow in accordance with one or more aspects of the present invention.
Figure 9B:
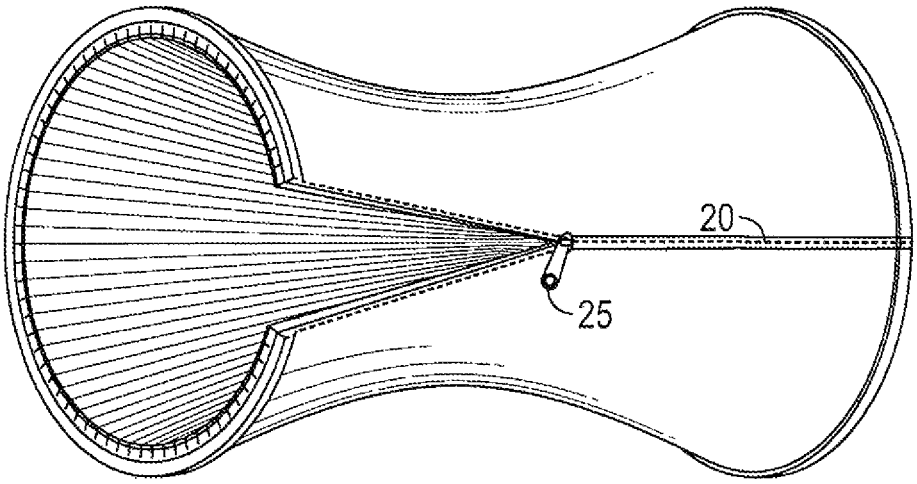
FIG. 9B shows a perspective view of a partially assembled neck pillow in accordance with one or more aspects of the present invention.
Figure 9C:
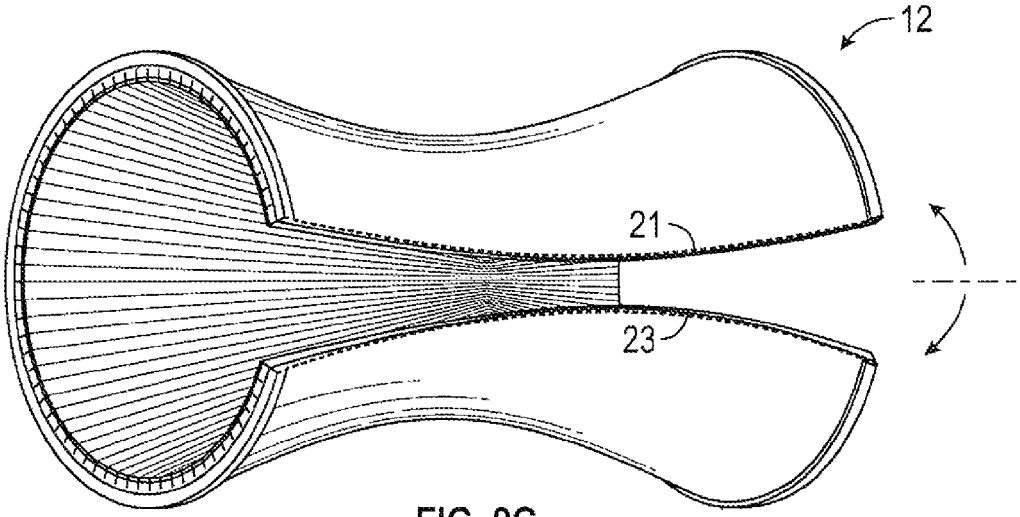
FIG. 9C shows a perspective view of a neck pillow having the longitudinal edges unfastened in accordance with one or more aspects of the present invention.
Figure 9D:
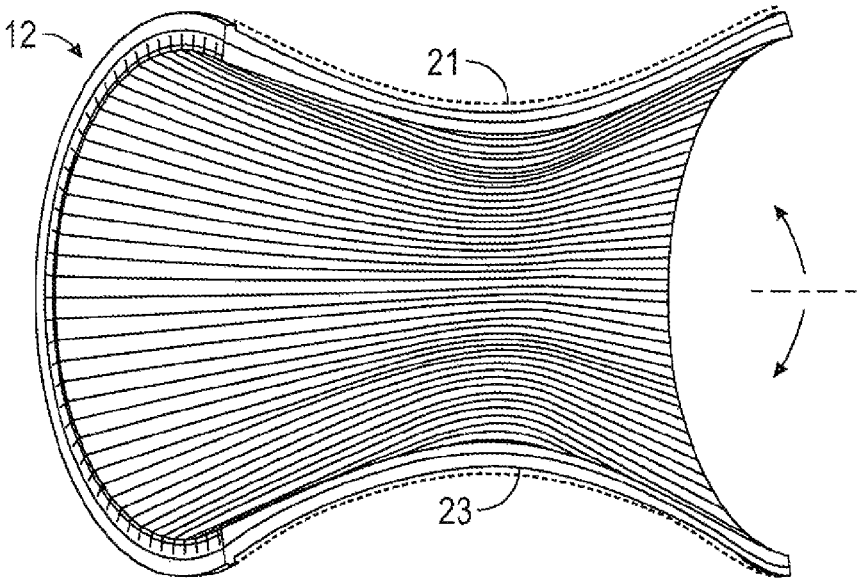
FIG. 9D shows a perspective view of a neck pillow partially unfolded in accordance with one or more aspects of the present invention.
Figure 9E:
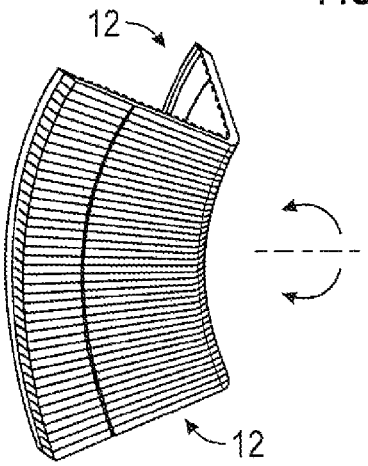
FIG. 9E shows a perspective view of an assembled neck pillow in accordance with one or more aspects of the present invention.
Figure 9F:
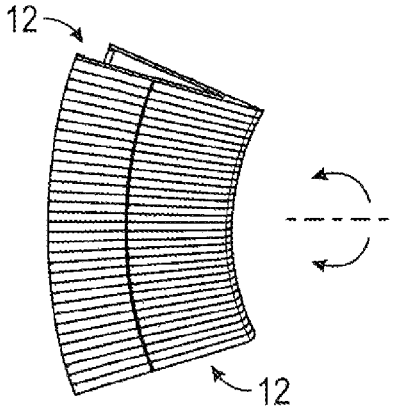
FIG. 9F shows a perspective view of a neck pillow partially folded in accordance with one or more aspects of the present invention.
Figure 9G:
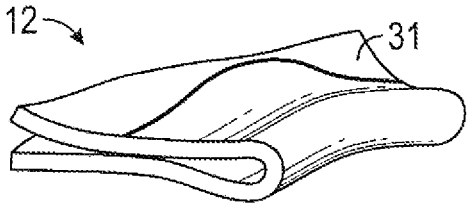
FIG. 9G shows a perspective view of a neck pillow folded in accordance with one or more aspects of the present invention.
Figure 9H:
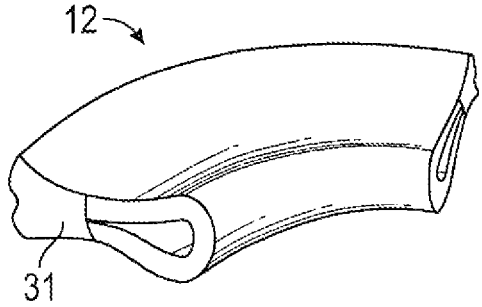
FIG. 9H shows a perspective view of a neck pillow folded and configured for storing in accordance with one or more aspects of the present invention.
Figure 10:
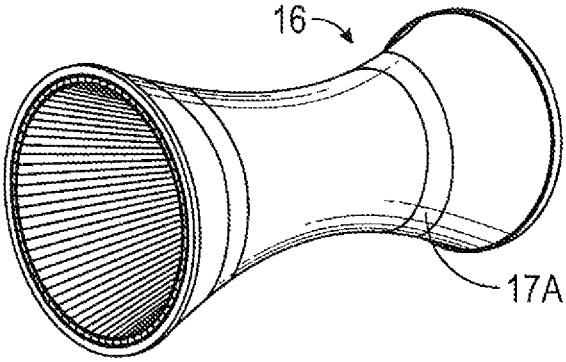
FIG. 10 shows another embodiment of a neck pillow in accordance with one or more aspects of the present invention.
Figure 11A:
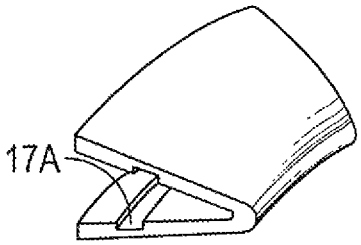
FIG. 11A shows a perspective view of an unassembled neck pillow having channels in accordance with one or more aspects of the present invention.
Figure 11B:
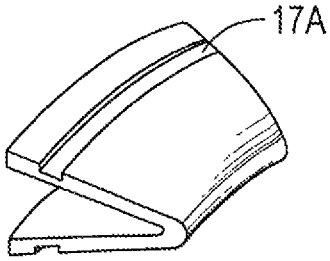
FIG. 11B shows a perspective view of an unassembled neck pillow having channels in accordance with one or more aspects of the present invention.
Figure 11C:
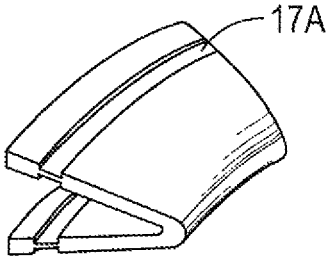
FIG. 11C shows a perspective view of an unassembled neck pillow having channels in accordance with one or more aspects of the present invention.

To assemble the neck pillow 10, the same steps shown in FIGS. 9A-9H may be performed but in reverse order. When assembling the neck pillow 10, the user may select a desired firmness and or comfort level. For example, as shown in FIG. 9A, the neck pillow 10 is at the standard firmness level. However, if a firmer feel is desired, the planar member 12 may be rolled in a scroll like manner. A tightly rolled scroll of the planar member 12 may provide a firmer feel for the neck pillow 10. Alternatively, for a softer feel, the neck pillow 10 may be opened in a semi-opened up position as in FIG. 9D with the ends 10A forming a "C" shape such that the neck pillow 10 supports more of the neck and head of the individual.

While the above embodiments have been described, the neck pillow 10 may be formed in other manners or take other shapes without departing from the spirit and scope of the present invention. For example, the neck pillow may be a solid filled one piece neck pillow without the second connecting device 28. Thus the neck pillow cannot be disassembled. This embodiment would be more for home use that does not require as much portability. Alternatively, the neck pillow may be designed such that the planar member 12 has some depth/elevation such that when the neck pillow 10 is assembled, the neck pillow 10 is not hollow but is filled-non-hollow. The non-hollow form can be shaped to act the same way with less dense materials in the middle of the tube and denser material at the ends. Further, while the embodiment is described as a neck pillow 10, it may be used on other areas of the body without departing from the spirit and scope of the present invention.

FIGS. 16-19 illustrate how different neck support profiles may be achieved by providing a foam layer or planar member of the neck pillow having varying thickness between a central portion of the foam layer or planar member and distal ends of the foam layer or planar member. In particular it has been recognized that having a thinner central portion which tapers into a thicker distal portion improves lateral support of a user's neck as shown in FIG. 1B and FIG. 2. The resistance to compression between the central portion and the distal portions of the neck pillow can be varied by varying the height or thickness of the foam layer. As shown in FIGS. 16B to 19, thickness of the foam layer or planar member may increase from the central portion of the foam layer to the distal ends of the foam layer so that the distal ends are thicker than the central portion. Thus, the neck pillow as shown in FIGS. 16B to 19 may have lower resistance at the central portion to facilitate folding of the neck pillow as shown in FIGS. 9E and 9F. The thicker distal ends provide greater resistance at the distal ends; medium thickness midway between the central portion and the distal ends provides medium resistance; and a thinner foam layer at the central portion provides lower resistance near the central portion of the neck support pillow, thus improving lateral support of a user's neck by increasing resistance at the distal ends while providing a softer more flexible central portion to more easily compress in response to force or stress from the weight of a user's neck.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A pillow for supporting the head and neck of a user comprising:

a tubular structure, wherein the tubular structure has a first conical half and a second conical half;

a depression formed between the first conical half and the second conical half, the depression suitable for supporting a neck of a user;

wherein the tubular structure is formed of a single planar member, the single planar member rolled to form the tubular structure;

wherein the single planar member comprises a plurality of layers, a first layer being harder than a second layer; and wherein the first layer comprises a plurality of strips.

2. The pillow of claim 1, wherein the first layer comprises a plurality of strips, wherein each of the plurality of strips is trapezoidal in shape for resisting compression.

3. The pillow of claim 1, further comprising an attachment device for holding the single planar member in the tubular structure form.

4. The pillow of claim 3, wherein the attachment device comprises a cover for housing the single planar member in the tubular structure form.

5. The pillow of claim 3, wherein the attachment device is selected from the group consisting of a zipper, at least one locking strap, and male/female connectors.

6. The pillow of claim 1, further comprising a collar member attached to each end of the tubular structure.

7. The pillow of claim 6, where the collar member comprises:

a frame member for attaching the collar member to the tubular structure; and a resistance device coupled to the frame member.

8. The pillow of claim 7, wherein the resistance device comprises a foam strip, the foam strip separated into a plurality of sections.

9. A pillow for supporting the head and neck of a user comprising:

a tubular structure formed of a single planar member, the single planar member rolled to form the tubular structure having a first conical half and a second conical half;

a depression formed between the first conical half and the second conical half, the depression suitable for supporting a neck of a user;

an attachment device for holding the single planar member in a form of the tubular structure;

a collar member attached to each end of the tubular structure;

wherein the single planar member comprises a plurality of layers, a first layer being harder than a second layer; and wherein the first layer comprises a plurality of strips.

10. The pillow of claim 9, wherein each of the plurality of strips is trapezoidal in shape for resisting compression.

11. The pillow of claim 9, wherein the attachment device comprises a cover for housing the single planar member in the tubular structure form.

12. The pillow of claim 11, wherein the cover has a pull over flap.

13. The pillow of claim 9, wherein the attachment device is selected from the group consisting of a zipper, at least one locking strap, and male/female connectors.

14. The pillow of claim 9, where the collar member comprises:

a frame member for attaching the collar member to the tubular structure; and a resistance device coupled to the frame member.

15. The pillow of claim 9, wherein the tubular structure has a plurality of holes formed through the tubular structure.

16. A neck and head support device comprising:

a neck support member having a first conical half and a second conical half, wherein the first conical half and the second conical half are adjoined at a central portion so that the neck support member forms a substantially hourglass shape;

wherein the neck support member includes a hollow interior space;

wherein a width of the first conical half between the hollow interior space and an outer surface of the first conical half is tapered so as to be thicker at a distal portion of the first conical half and thinner at a proximal portion of the first conical half, the proximal portion of the first conical half being located adjacent the central portion of the neck support member; and wherein a width of the second conical half between the hollow interior space and an outer surface of the second conical half is tapered so as to be thicker at a distal portion of the second conical half and thinner at a proximal portion of the second conical half, the proximal portion of the second conical half being located adjacent the central portion of the neck support member.

17. The neck and head support device of claim 16, wherein the neck support member has an opening to the hollow interior space of the neck support member disposed in a base end of the first conical half of the neck support member.

18. The neck and head support device of claim 17, wherein the neck support member has an opening to the hollow interior space of the neck support member disposed in a base end of the second conical half of the neck support member.

19. The neck and head support device of claim 18, wherein the neck support member is enclosed in a fabric covering.

* * * * *